US006139273A

United States Patent [19]

Schwarz et al.

[11] Patent Number: 6,139,273

[45] Date of Patent: Oct. 31, 2000

[54] RADIAL FLOW FAN

[75] Inventors: Stefan Helmut Schwarz, Rochester Hills; Thomas Hermann Mersch, Birmingham, both of Mich.

[73] Assignee: Valeo Climate Control, Inc., Auburn Hills, Mich.

[21] Appl. No.: 09/064,288

[22] Filed: Apr. 22, 1998

[51] Int. Cl.[7] ..... B23H 1/16

[52] U.S. Cl. ..... 416/185

[58] Field of Search ..... 416/175, 178, 416/180, 182, 183, 185, 186 R, 187

[56] References Cited

U.S. PATENT DOCUMENTS

| | | | |
|---|---|---|---|
| Re. 13,200 | 2/1911 | Capell | 142/36 |
| 588,513 | 8/1897 | Ward | 416/183 X |
| 809,711 | 1/1906 | Maier | 416/183 |
| 912,362 | 2/1909 | Capell | 416/183 |
| 991,134 | 5/1911 | Capell | 416/183 |
| 1,174,938 | 3/1916 | Montgomery | 416/183 |
| 1,471,141 | 10/1923 | Capell | 416/175 |
| 2,065,716 | 12/1936 | Leonard | 416/183 |
| 2,217,231 | 10/1940 | Morse | 416/185 |
| 4,900,228 | 2/1990 | Yapp | 416/183 |
| 4,936,288 | 6/1990 | Lazard | 416/187 X |
| 5,279,396 | 1/1994 | Estaque et al. | 416/186 R X |
| 5,478,205 | 12/1995 | Chou et al. | 416/178 |

*Primary Examiner*—John E. Ryznic
*Attorney, Agent, or Firm*—Morgan & Finnegan

[57] ABSTRACT

A radial flow fan wheel has a longitudinal axis and consists of an annular member and a plurality of first and second blade members. The first and second blade members depend from the annular member substantially parallel to the axis of the first blade members being disposed on a first pitch circle and the second blade member being disposed on a second pitch circle which has a radius less than a radius of the first pitch circle.

17 Claims, 2 Drawing Sheets

RADIAL FLOW FAN

FIELD OF THE INVENTION

The invention relates to radial flow fan wheels, and more particularly but not exclusively to radial flow fan wheels of the type used as blowers in vehicle climate control systems.

BACKGROUND OF THE INVENTION

Radial flow fan wheels are used widely in automotive heating, ventilation and air conditioning systems as well as in other systems where a relatively quiet movement of air is required.

Such fan wheels normally consist of a plurality of blades (for example thirty) depending from an annular member and extending parallel to a longitudinal axis of the fan wheel to define a substantially cylindrical envelope. Each blade is a thin elongated member having a cross-section defined by a pair of generally curved surfaces.

The blades are generally spaced apart regularly on a pitch circle, the spacing between the blades allows air which is input through the central part of the annulus to be expelled by the action of the blades and between the blades.

There are, however problems with known blower wheels in that the efficiency of the wheel is not optimised due to recirculation of air between the blades. The reduced efficiency is shown in the form of increased noise level from the blower, and as a result a higher input power is required to move the same volume of air.

Accordingly, it is an object of the present invention to at least partially mitigate the above-mentioned problems.

DISCUSSION OF THE INVENTION

According to one embodiment the present invention provides for a radial flow fan wheel having a longitudal axis, the fan wheel comprising an annular member and a first plurality of first blade members, the first plurality of first blade members depending from the annular member and having respective radially outer tip regions, the first blade members being disposed substantially parallel to the axis and the tip regions being disposed about a first pitch circle to define a substantially cylindrical envelope, wherein the fan wheel further comprises a second plurality of second blade members, the second plurality of second blade members depending from the annular member and being disposed substantially parallel to the axis, the second blade members having respective radially outer tip regions, the tip regions of the second blade members being disposed about a second pitch circle having a radius less than a radius of the first pitch circle.

According to a further aspect of the present invention there is provided a radial flow fan wheel having a longitudinal axis, comprising an annular member and a plurality of first and second blade members, the first and second blade members depending from the annular member substantially parallel to the axis, the first blade members being disposed on a first pitch circle and the second blade members being disposed on a second pitch circle having a radius less than a radius of the first pitch circle, the first and second blade members being equal in number, such that a portion of each second blade member is disposed between two adjacent first blade members and closer to one of the adjacent first blade members than to the other.

DESCRIPTION OF PREFERRED EMBODIMENTS

In the figures like references numerals refer to like parts.

Figure 1:
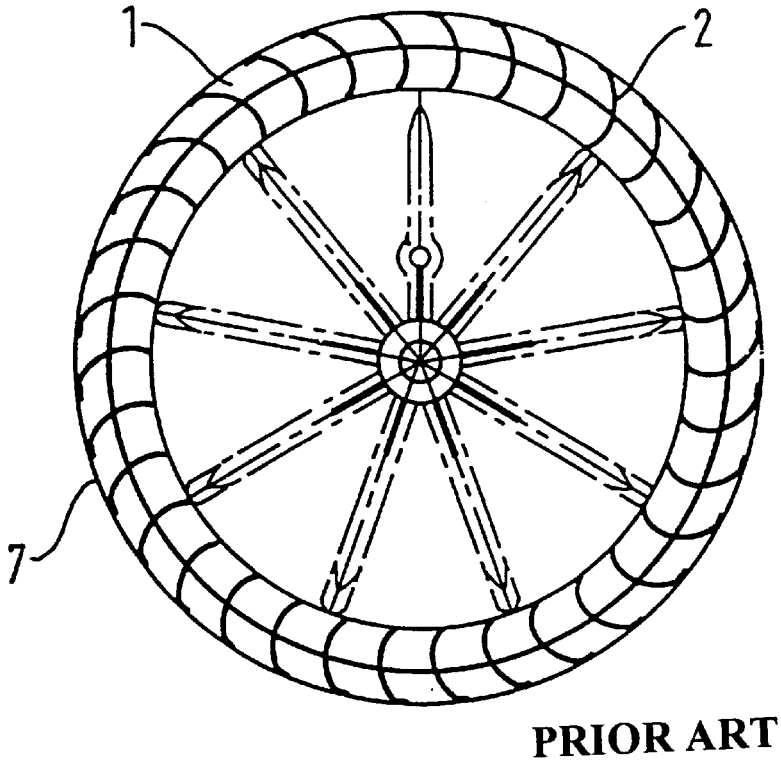
FIG. 1 shows a cross-sectional view through a conventional radial flow fan wheel taken along the axis of the fan wheel.
Figure 2:
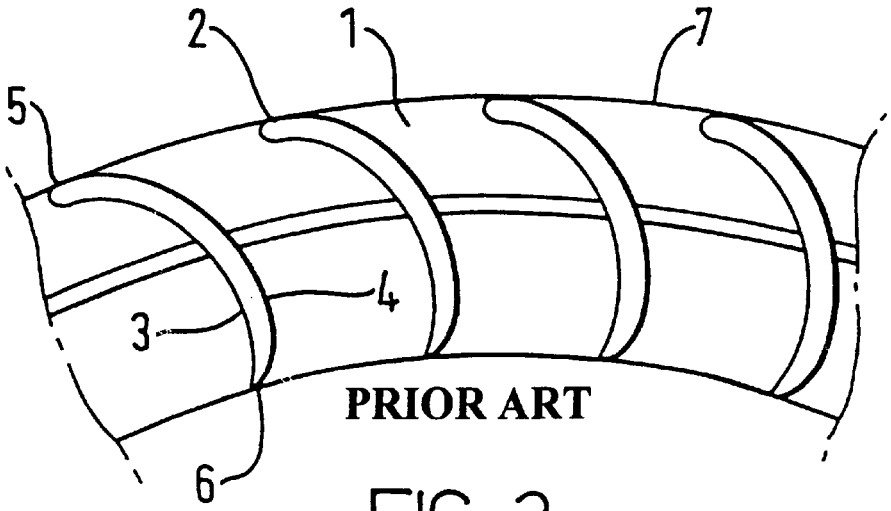
FIG. 2 shows a detailed view of a portion of the fan wheel of FIG. 3.

Referring to FIG. 1 a conventional radial flow fan wheel has thirty-four fan blades 2 depending from a support ring 1. The blades are substantially uniformally spaced around the support ring and extend substantially parallel to a longitudinal axis of the fan wheel so as to define a substantially cylindrical envelope. The blades have outer tip regions disposed on a first pitch circle 7 substantial coincident with the circumference of the support ring. Referring to FIG. 2, the blades are elongate members having a cross-section defined by a pair of generally curved surfaces a concave inner surface 3 and a convex outer surface 4. In the radially outer tip region 5 the transition between the inner surface 3 and the outer surface 4 is via a relatively larger radius portion whereas at the radially inner tip region 6 there is a sharp transition between those surfaces. The shape of the blade is determined by the application.

Figure 3:
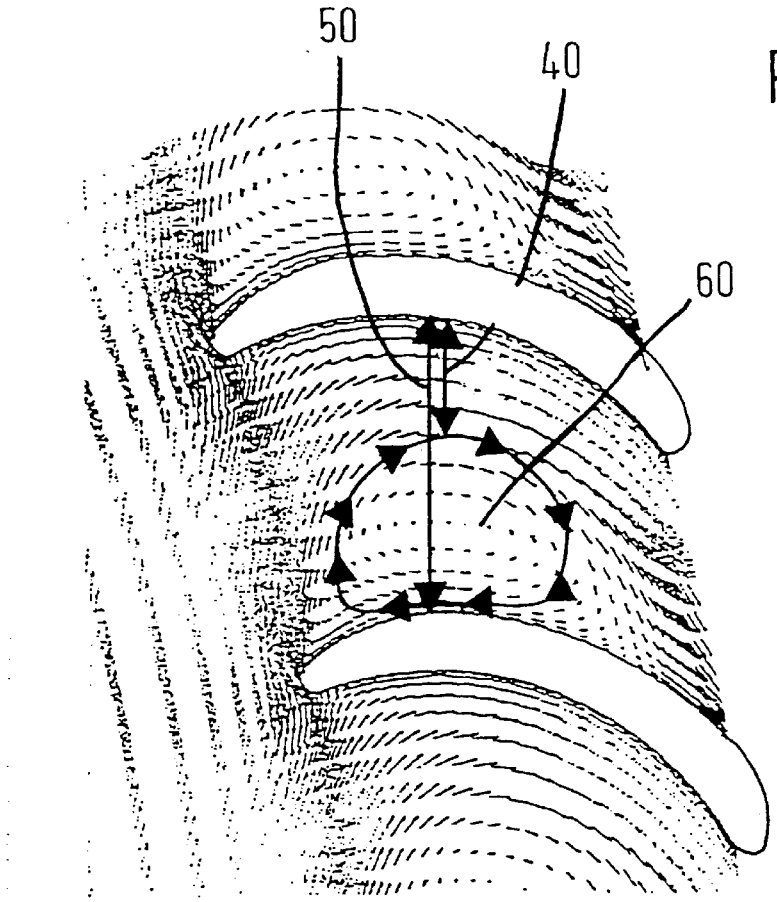
FIG. 3 shows the air flow of a conventional fan wheel.

Turning now to FIG. 3, one of the problems with the conventional fan is that there is a pressure variation in the gaps between the blades which, in the region of the mid-points of the blades causes re-circulation of air to take place. Clearly the prime purpose of the blades is to cause air to move radially outwardly and this is achieved by entraining air in the region close to the leading surface of the blades. If the blades are widely spaced, then there will be low pressure regions between the blades and air moving along the leading surface will tend, outwardly, to be diverted into this low pressure region instead of flowing outwardly. The reduction in efficiency is effectively due to only a relative small first portion 40 of the spacing 50 between the blades being used to move the air. Air in the remaining region 60 merely eddies around. It would be possible to overcome this to a certain extent by reducing the spacing of the blades, but creating narrowly spaced blades has an undesired throttling effect on the movement of air.

Figure 4:
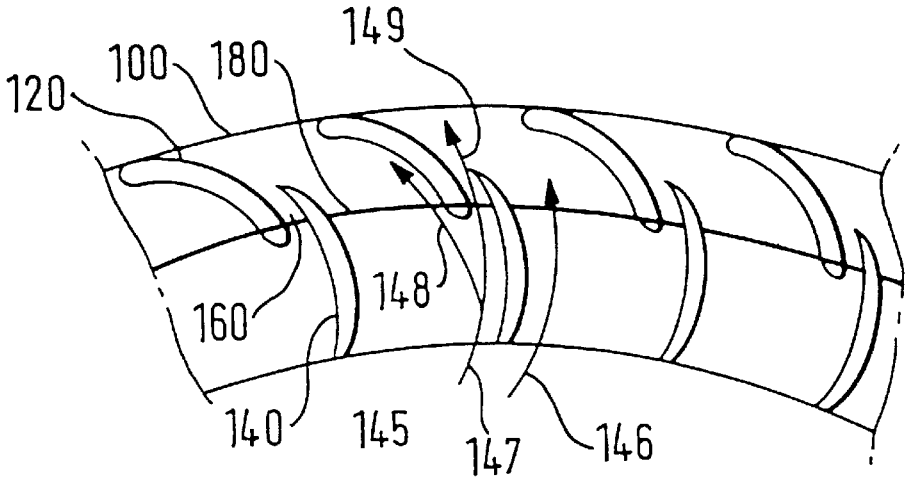
FIG. 4 shows a detailed view of a fan wheel in accordance with the present invention.

Turning to FIG. 4, a fan wheel in accordance with the embodiment substitutes for the set of single blades of the prior art, pairs of blades, each blade having a smaller radial extent than the single blades of the prior art. Thus, the fan wheel has an annular member 100 and a first plurality of first outer blade members 120 and a second plurality of second inner blade members 140. The first blade members 120 are disposed radially outwardly of the inner blade members 140 although the inner blade members extend beyond the inner tip region of the outer blade members to overlap therewith. A relatively narrow gap 160 exists in the overlap region between one inner blade and the nearest adjacent outer blade whereas a relatively large gap 180 is provided between each inner blade and the other adjacent outer blade.

In operation, each inner blade inner tip region 145 divides the air flow into two subflows 146,147. The first flow 146 is along the leading edge of the inner blade 140 and the second flow 147 is along the trailing edge of the inner blade 140. As the flow 147 becomes incident on the inner tip region of the outer blade member 120, it again bifurcates into a main flow 148 along the trailing surface of the outer blade 120 and a minor flow 149 along the leading surface of the outer blade member 120. The first flow 146 also flows generally along the outer surface of the outer blade member 120, and the combined effect of the first flow 146 and the minor flow 149 is to substantially reduce or eliminate re-circulation.

It will of course be clear to one skilled in the art that avoiding re-circulation results in an increase of air flow through the radial flow fan wheel blower which in turn leads to an improvement in the noise performance and overall efficiency of the blower wheel.

Although the embodiments show a particular geometry of inner and outer blade sections, it will be clear to one skilled in the art that blades of other shapes could be used according to the application intended. It will also be clear to one skilled in the art that instead of providing two blade sections, three or more could be provided if so desired.

What is claimed is:

1. A radial flow fan wheel having a longitudinal axis, comprising:

an annular member;

a plurality of first and second blade members;

said first and second blade members depending from said annular member substantially parallel to said axis;

said first blade members being disposed on a first pitch circle;

said second blade members being disposed on a second pitch circle having a radius less than a radius of said first pitch circle;

said second blade members dividing the airflow into a first subflow and a second subflow, wherein the first subflow is along leading edges of the second blade members, and the second subflow is along trailing edges of the second blade members;

said first blade members bifurcating the second subflow into a main flow along trailing surfaces of said first blade members, and a minor flow along leading surfaces of said first blade members; and said leading edge of said first blade members extends beyond the leading edge of the second blade members.

2. The radial flow fan wheel of claim 1 wherein each said first blade member has a radially outer tip region and a radially inner tip region;

and said second blade members each have a respective radially outer tip region and a respective radially inner tip region, wherein the radially outer tip region of the second blade members lie on a third pitch circle and the radially inner tip region of the first blade members lie on a fourth pitch circle, a radius of the third pitch circle being greater than a radius of the fourth pitch circle.

3. The radial flow fan wheel of claim 1 wherein said first plurality of said blade members is equal in number to said second plurality of said blade members.

4. A radial flow fan wheel having a longitudinal axis, said fan wheel comprising:

an annular member;

a first plurality of first blade members, said first plurality of first blade members depending from said annular member and having respective radially outer tip regions;

said first blade members being disposed substantially parallel to said axis and said tip regions being disposed about a first pitch circle to define a substantially cylindrical envelope;

a second plurality of second blade members, said second plurality of second blade members depending form said annular member and being disposed substantially parallel to said axis;

said second blade members having respective radially outer tip regions, said tip regions of said second blade members being disposed about a second pitch circle having a radius less than a radius of said first pitch circle;

said second blade members dividing the airflow into a first subflow and a second subflow, wherein the first subflow is along leading edges of the second blade members, and the second subflow is along trailing edges of the second blade members;

said first blade members bifurcating the second subflow into a main flow along trailing surfaces of said first blade members, and a minor flow along leading surfaces of said first blade members; and said leading edge of said first blade members extends beyond the leading edge of the second blade members.

5. The radial flow fan wheel of claim 1 wherein each said first blade member has a radially outer tip region and a radially inner tip region.

6. The radial flow fan wheel of claim 5 wherein each said second blade member has a radially outer tip region and a radially inner tip region.

7. The radial flow fan wheel of claim 6 wherein the radially outer tip region of the second blade members lies on a third pitch circle and the radially inner tip region of the first blade members lie on a fourth pitch circle, a radius of the third pitch circle being greater than a radius of the fourth pitch circle.

8. A vehicle climate control system having at least one radial flow fan, the fan comprising:

an annular member;

a plurality of first and second blade members;

said first and second blade members depending from said annular member substantially parallel to said axis;

said first blade members being disposed on a first pitch circle;

said second blade members being disposed on a second pitch circle having a radius less than a radius of said first pitch circle;

said second blade members dividing the airflow into a first subflow and a second subflow, wherein the first subflow is along leading edges of the second blade members, and the second subflow is along trailing edges of the second blade members;

said first blade members bifurcating the second subflow into a main flow along trailing surfaces of said first blade members, and a minor flow along leading surfaces of said first blade; and said leading edge of said first blade members extends beyond the leading edge of the second blade members.

9. A system according to claim 8 wherein each said first blade member has a radially outer tip region and a radially inner tip region.

10. The system according to claim 9 wherein each said second blade member has a radially outer tip region and a radially inner tip region.

11. The system according to claim 10 wherein the radially outer tip region of the second blade members lie on a third pitch circle and the radially inner tip region of the first blade members lie on a fourth pitch circle, a radius of the third pitch circle being greater than a radius of the fourth pitch circle.

12. A motor vehicle having at least one radial flow fan, the fan comprising:

an annular member;

a plurality of first and second blade members;

said first and second blade members depending from said annular member substantially parallel to said axis;

said first blade members being disposed on a first pitch circle;

said second blade members being disposed on a second pitch circle having a radius less than a radius of said first pitch circle;

said second blade members dividing the airtflow into a first subflow and a second subflow, wherein the first subflow is along leading edges of the second blade members, and the second subflow is along trailing edges of the second blade members;

said first blade members bifurcating the second subflow into a main flow along trailing surfaces of said first blade members and a minor flow along leading surfaces of said first blade members; and said leading edge of said first blade members extends beyond the leading edge of the second blade members.

13. The vehicle according to claim 12 wherein each said first blade members has a radially outer tip region and a radially inner tip region.

14. The vehicle according to claim 13 wherein each said second blade members have a radially outer tip region and a radially inner tip region.

15. The vehicle according to claim 14 wherein the radially outer tip region of the second blade members lie on a third pitch circle and the radially inner tip region of the first blade members lie on a fourth pitch circle, a radius of the third pitch circle being greater than a radius of the fourth pitch circle.

16. A method of directing air flow through a wheel of a radial flow fan including a plurality of inner blade members and a plurality of outer blade members, the method comprising:

dividing the airflow into a first subflow and a second subflow, wherein the first subflow is along leading edges of the inner blade members, and the second subflow is along trailing edges of the inner blade members;

bifurcating the second subflow into a main flow along trailing surfaces of the outer blade members, and a minor flow along leading surfaces of the outer blade members; and directing the first subflow along outer surfaces of the outer blade members.

17. The method according to claim 16, further comprising combining the first subflow and the minor flow.

* * * * *